US005975432A

United States Patent [19]

Han

[11] Patent Number: 5,975,432

[45] Date of Patent: Nov. 2, 1999

[54] SPRAY NOZZLE

[76] Inventor: Ki Su Han, 2249 Lerona Ave., Rowland Heights, Calif. 91748

[21] Appl. No.: 08/971,228

[22] Filed: Nov. 15, 1997

[51] Int. Cl.[6] ..... B05B 9/01

[52] U.S. Cl. ..... 239/526; 239/271; 239/288.5; 239/499; 239/527; 239/583; 47/48.5; 111/7.1; 137/381

[58] Field of Search ..... 239/499, 519, 239/525, 526, 527, 583, 600, 271, 288, 288.3, 288.5, 289; 111/7.1–7.4; 47/48.5 G, 48.5 M; 137/381; 251/155

[56] References Cited

U.S. PATENT DOCUMENTS

| | | | |
|---|---|---|---|
| 1,937,172 | 11/1933 | Starner et al. | 111/7.1 |
| 2,621,076 | 12/1952 | Barton | 239/526 X |
| 2,893,648 | 7/1959 | Berry | 239/288.5 X |
| 3,037,710 | 6/1962 | Kusznier | 239/526 |
| 3,215,350 | 11/1965 | Hetrick | 239/288.5 |
| 3,672,380 | 6/1972 | Schuster | 239/288.5 X |
| 3,774,556 | 11/1973 | Poll | 111/7.2 |
| 5,694,716 | 12/1997 | Bible | 47/48.5 |

*Primary Examiner*—Kevin P. Shaver
*Assistant Examiner*—Steven J. Ganey

[57] ABSTRACT

A spray nozzle adapter is used with a conventional spray nozzle having a nozzle plug for regulating the flow of fluid in response to a control lever. The spray nozzle adapter has an intake coupler having an axially extending cylindrical wall defining an intake orifice constructed to couple to the spray nozzle, a shaft coupled to the intake coupler and a valve assembly coupled to the nozzle plug and disposed in the fluid passage of the first shaft for controlling the flow of fluid from the spray nozzle in response to movement of the spray nozzle control lever. The valve assembly includes a valve and a lever coupled to the valve. The valve has a plug for controlling the flow of fluid from the outlet orifice. The lever is securely coupled to the nozzle plug of the spray nozzle to relay the movement of the nozzle plug to the valve. The spray nozzle adapter also has a cone-shaped deflector mounted to the intake coupler to substantially surround the shaft. The deflector is used to block the splashing of water and dirt and includes a plurality of rings axially interleaved and connected with elastic materials to allow the plurality of rings to retract thereby exposing the shaft.

19 Claims, 4 Drawing Sheets

SPRAY NOZZLE

BACKGROUND OF THE INVENTION

1. Field of the Invention

This invention relates to a spray nozzle, and more particularly, to an extended spray nozzle adapter for burrowing into the ground to facilitate the loosening or removal of weeds or other unwanted plant growth.

2. Description of Related Art

Spray nozzles for watering lawns and gardens are well known. These nozzles, when connected to a pressurized water source permit the spraying of water to extended areas. A conventional spray nozzle uses a handgun type nozzle having a trigger handle. Depending on the degree of depression of the trigger with respect to the handle, the nozzle will produce either a spray or stream of pressurized water.

These conventional nozzles are useful and made for delivering water or other fluids above the ground. However, due to their design, they are not particularly effective for delivering water beneath the ground for loosening dirts or irrigating.

SUMMARY OF THE DISCLOSURE

It is an object of the present invention to provide a spray nozzle, and more particularly a nozzle adapter, for delivering water beneath the ground which is relatively inexpensive to manufacture and which can be readily assembled with a conventional spray nozzle.

According to a first embodiment of the present invention, a spray nozzle adapter is used with a conventional spray nozzle having a nozzle plug for regulating the flow of fluid in response to a control lever. The spray nozzle adapter has an intake coupler having an axially extending cylindrical wall defining an intake orifice constructed to couple to the spray nozzle, a shaft coupled to the intake coupler and a valve assembly coupled to the nozzle plug and disposed in the fluid passage of the first shaft for controlling the flow of fluid from the spray nozzle in response to the movement of the control lever of the spray nozzle. The valve assembly includes a valve and a lever coupled to the valve. The valve has a plug for controlling the flow of fluid out of the outlet orifice. The lever is securely coupled to the nozzle plug of the spray nozzle to relay the movement of the nozzle plug to the valve. The spray nozzle adapter also has a cone-shaped deflector coupled to the intake coupler to substantially surround the shaft. The deflector includes a plurality of rings axially interleaved and connected with an elastic material to allow the plurality of rings to retract to expose the shaft.

According to a second embodiment of the present invention, a spray nozzle adapter has an intake coupler having an axially extending cylindrical wall defining an intake orifice constructed to couple to the spray nozzle; a first shaft coupled to the intake coupler, the first shaft having a substantially elongated inner wall defining a first fluid passage and a first outlet orifice; a second shaft coupled to the intake coupler and disposed spatially adjacent to the first shaft, the second shaft having a substantially elongated inner wall defining a second fluid passage and a second outlet orifice; and a valve assembly coupled to the nozzle plug and disposed in both fluid passages of the first and second shafts for controlling the flow of fluid from the spray nozzle in response to movement of the control lever of the spray nozzle.

The valve assembly includes a U-shaped valve and a hook coupled to the valve. The valve has two prongs, each prong having a plug for controlling the flow of fluid through its respective outlet orifice. One end of the hook is secured to an aperture formed in the valve and the opposite end of the hook is coupled to the nozzle plug of the spray nozzle to relay the movement of the nozzle plug to the valve. Each prong of the valve has a plurality of legs protruding from the prong to substantially maintain the position of the nozzle of the valve in the middle of the respective outlet orifice.

The spray nozzle adapter of the second embodiment further includes a deflector coupled to the intake coupler and substantially surrounding the first and second shafts. The deflector includes a plurality of rings axially interleaved and connected with an elastic material to allow the plurality of rings to retract to expose the shaft. The deflector includes a base portion having a cylindrical shape and is made of an elastic material to be placed in surrounding relation to the intake coupler.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
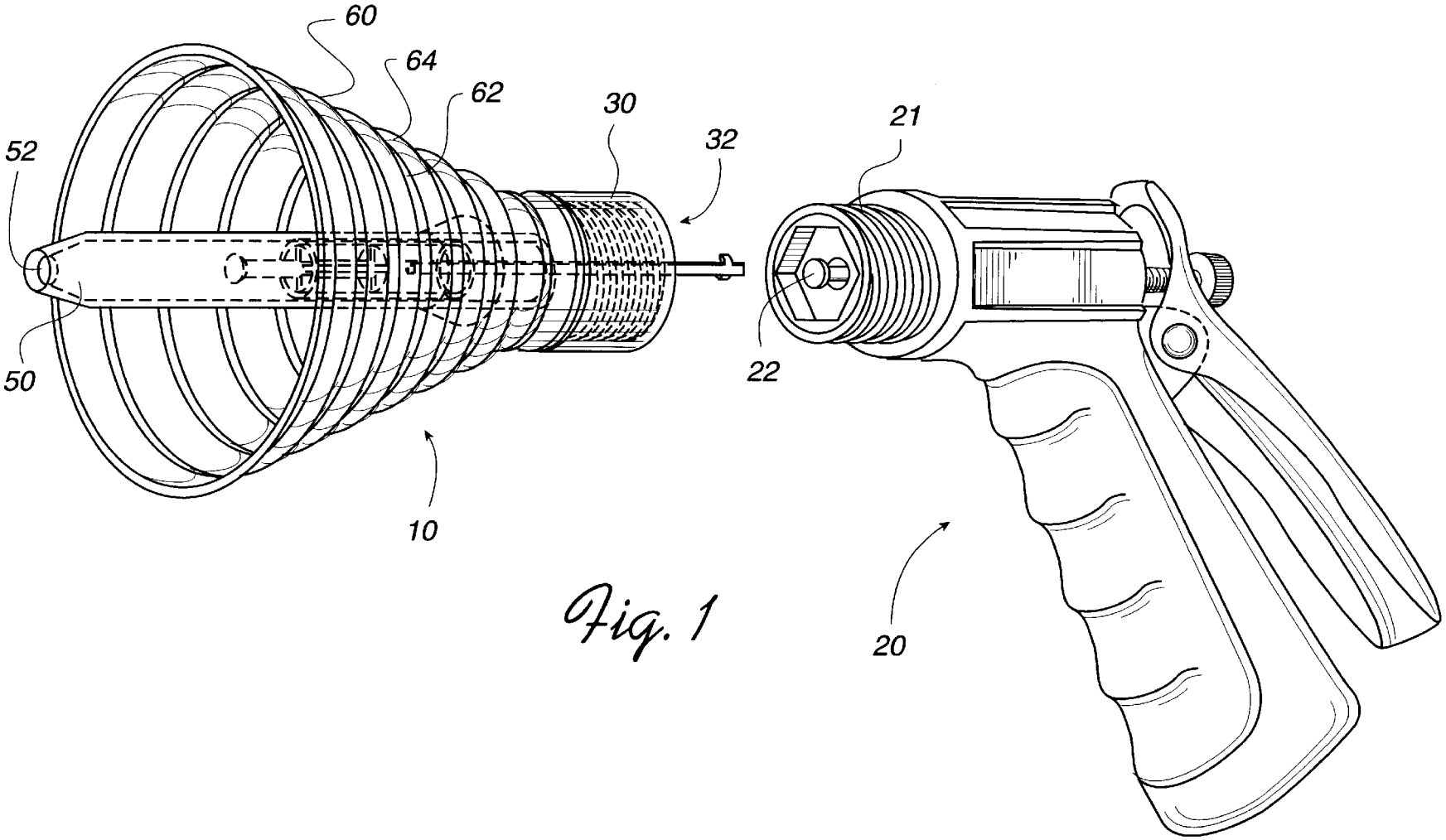
FIG. 1 illustrates a perspective view of a first embodiment of the extended fluid spray nozzle adapter which is used with a conventional spray nozzle.
Figure 2:
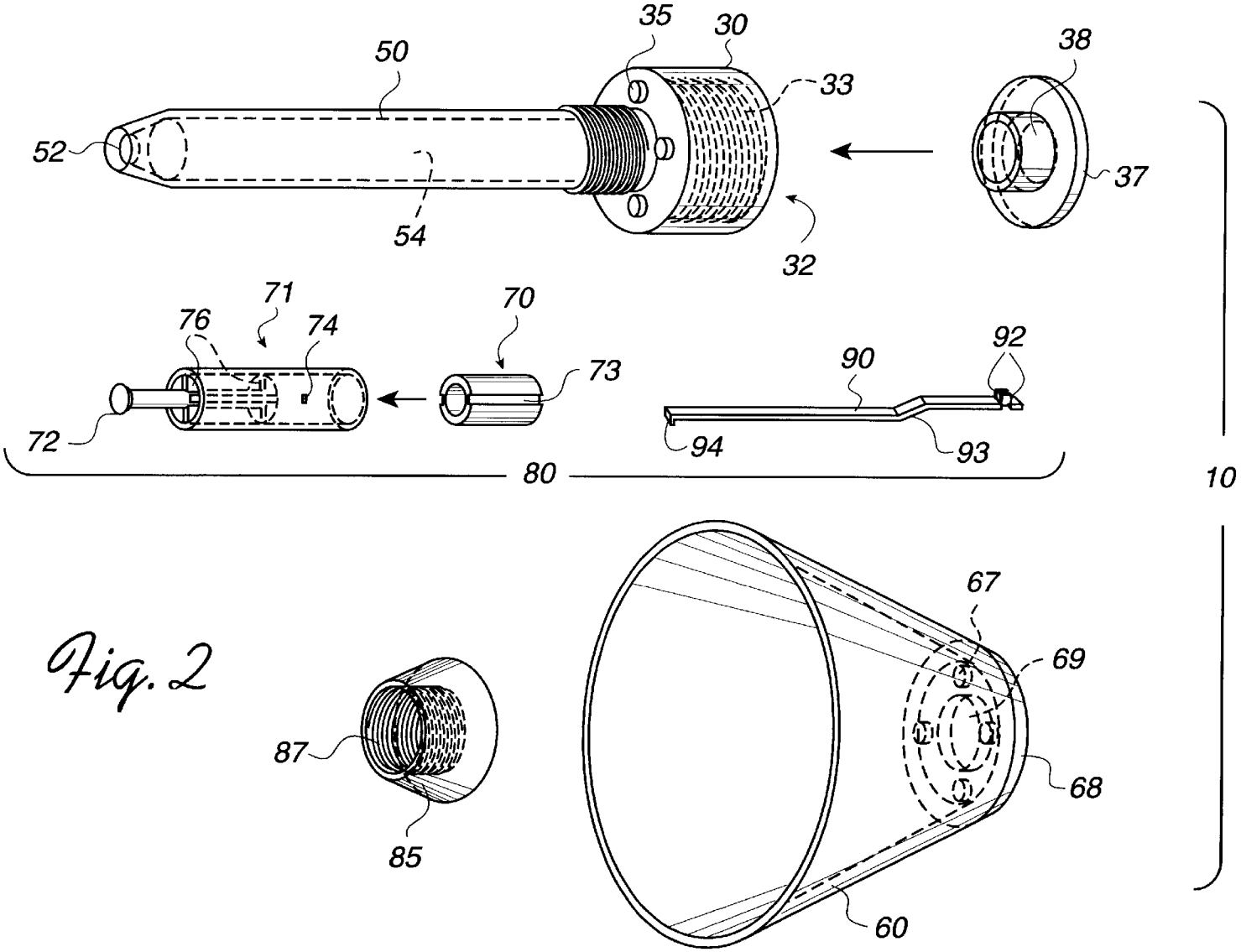
FIG. 2 illustrates an exploded view of the extended fluid spray nozzle adapter of FIG. 1.

FIGS. 1 and 2 illustrate a first embodiment of the present invention. The first embodiment of the spray nozzle adapter 10 shown in FIG. 1 is suitable for use with a conventional spray nozzle 20. The spray nozzle adapter 10 includes an intake coupler 30 defining an intake orifice 32, an extended shaft 50 coupled to the intake coupler 30, the extended shaft 50 defining an outlet orifice 52. The spray nozzle adapter 10 further includes a deflector member 60 for deflecting water away from the user.

FIG. 2 illustrates an exploded view which shows all of the internal components of the spray nozzle adapter 10. The intake coupler 30 preferably has a cylindrical shape with an internal thread 33 which matches that of the outer thread 21 of the spray nozzle 20 (shown in FIG. 1). The outer diameter of the intake coupler 30 is preferably the same as the cylindrical body of the spray nozzle 20 for matching construction and look. The intake coupler 30 forms an intake orifice 32 for receiving fluid from the spray nozzle 20. Securely attached to the opposite end of the intake coupler 30 is an extended shaft 50 which has an inner cavity 54 axially extending from the intake coupler 30 and the outlet orifice 52. The intake orifice 32, inner cavity 52 and the outlet orifice 52 are in fluid communication with each other.

On the outer top surface of the intake coupler 30, substantially surrounding the extended shaft 50, there are provided a plurality of protrusions 35 for receiving a deflector member 60. In the preferred embodiment, there are four protrusions 35 evenly spaced, such as approximately every 90 degrees, around the extended shaft 50.

There is also provided a washer 37 configured to be snugly fitted inside the intake coupler 30 to form a watertight seal between the spray nozzle 20 and the intake coupler 30. The washer 37 is made of any suitable liquid sealing material, such as rubber, plastic, metal, etc. The washer 37 may be of any suitable shape. In the preferred embodiment, the washer 37 is circular with a cylindrical extension 38 having a hollow interior protruding from the center of the body.

Provided in the inner cavity 54 of the extended shaft 50 is a valve assembly 80 having a lever 90, a reinforcing cylinder 70 and a valve 71. The valve 71 has a cylindrical body which is configured to fit snugly inside the inner cavity 54. The outer diameter of the valve 71 is slightly smaller than the inner diameter of the inner cavity 54 to allow the axial movement of the valve 71. The valve 71 also has a plug 72 which is used to plug the outlet orifice 52 to prevent the exiting of water. The diameter of the plug 72 is slightly larger than the diameter of the outlet orifice 52 to completely block the flow of water. The plug 72 is generally disposed in the center of the valve 71 supported by a plurality of ribs 76. Preferably, the ribs 76 are disposed in two separate locations to support the plug 72 substantially in the center of the valve 71.

Also illustrated in FIG. 2 is the lever 90 which couples the valve 71 of the spray nozzle adapter 10 to the nozzle plug 22 of the spray nozzle 20. At one end of the lever 90, there are two substantially parallel notches 92 for engaging the nozzle plug 22. The notches 92 may be curved to securely snap around the nozzle plug 22. The other end of the lever 90 has a hook 94 which is inserted into a hole 74 formed in the body of the valve 71. Once the hook 94 is properly inserted into the hole 74, a reinforcing cylinder 70 is inserted into the valve 71. The reinforcing cylinder 100 has a groove 73 formed along the axial direction of the outer body for receiving the lever 90. The reinforcing cylinder 100 securely couples the lever 90 with the valve 71. In the preferred embodiment, the lever 90 has a slanted mid-section 93 to place the notches 92 near the center of the of extended shaft 50 to engage the nozzle plug 22.

The deflector member 60 is shown in both FIGS. 1 and 2. The deflector member 60 in FIG. 2 is a simplified drawing of FIG. 1. The deflector member 60 has an accordion-type shell which allows it to be retracted when it is depressed against a surface, such as the ground. In particular, the deflector member 60 has a plurality of rigid rings 64 with flexible membranes 62 interposed between the rigid rings 64. The base portion 68 of the deflector member 60 has a center opening 69 and four smaller openings 67 evenly disposed around the center opening 69. The center opening 69 is for receiving the extended shaft 50, while the smaller openings 67 are for receiving the correspondingly disposed protrusions 35 on the intake coupler 30 to prevent the spray nozzle adapter 10 from rotating.

The assembling of the spray nozzle adapter 10 is as follows. First, the hook 94 of the lever 90 is inserted into the hole 74 of the valve. The reinforcing cylinder 70 is slid into the valve 71, firmly holding the lever 90 against the inner wall of the valve 71. The whole valve assembly 80 is then inserted in the inner cavity 54 of the extended shaft 50. The parallel notches 92 of the lever 90 are then slid or snapped behind the nozzle plug 22 to engage the nozzle plug 22 of the spray nozzle 20 (shown in FIG. 1).

The intake coupler 30 is screwed onto the spray nozzle 20 by engaging the matching thread 21. When the intake coupler 30 is completely mounted to the spray nozzle 20, the plug 72 of the valve 110 completely blocks the outlet orifice 52.

The deflector member 60 is disposed on the intake coupler 30 aligning the protrusions of the intake coupler 30 with the openings 67. The deflector member 60 is securely mounted by screwing a mounting bolt 85, which has an inner thread 87, onto the matching outer thread of the extended shaft 50.

The internal structure and component arrangement in the extended shaft 50 is illustrated in FIG. 1. The intake coupler 30 and the extended shaft 50 may be made of any suitable metal or rigid plastic material, such as steel, stainless steel, copper, etc.

The operation of the spray nozzle adapter 10 according to the first embodiment is discussed below in reference to FIG. 1. After a desired ground spot is located, the extended shaft 50 is inserted into the ground. Due to the narrow tip design of the extended shaft 50, penetration into the ground is relatively easy. When the extended shaft 50 is inserted either in vertical or in other angle, the deflector member 60 substantially covers the outer parameter around the extended shaft 50 to prevent any splashing of water or dirt. When the trigger is depressed in the spray nozzle 20, the nozzle plug 22 is pulled back which in turn retracts the valve 71. The plug 72 is also pulled back from the outlet orifice 52. As a result, pressurized liquid is emitted from the outlet orifice 52, loosening dirt in the surrounding regions. The softening of dirt allows for easy retraction of weed or unwanted plants from the ground. In addition, such use of the present invention provides effective underground irrigation.

Figure 3:
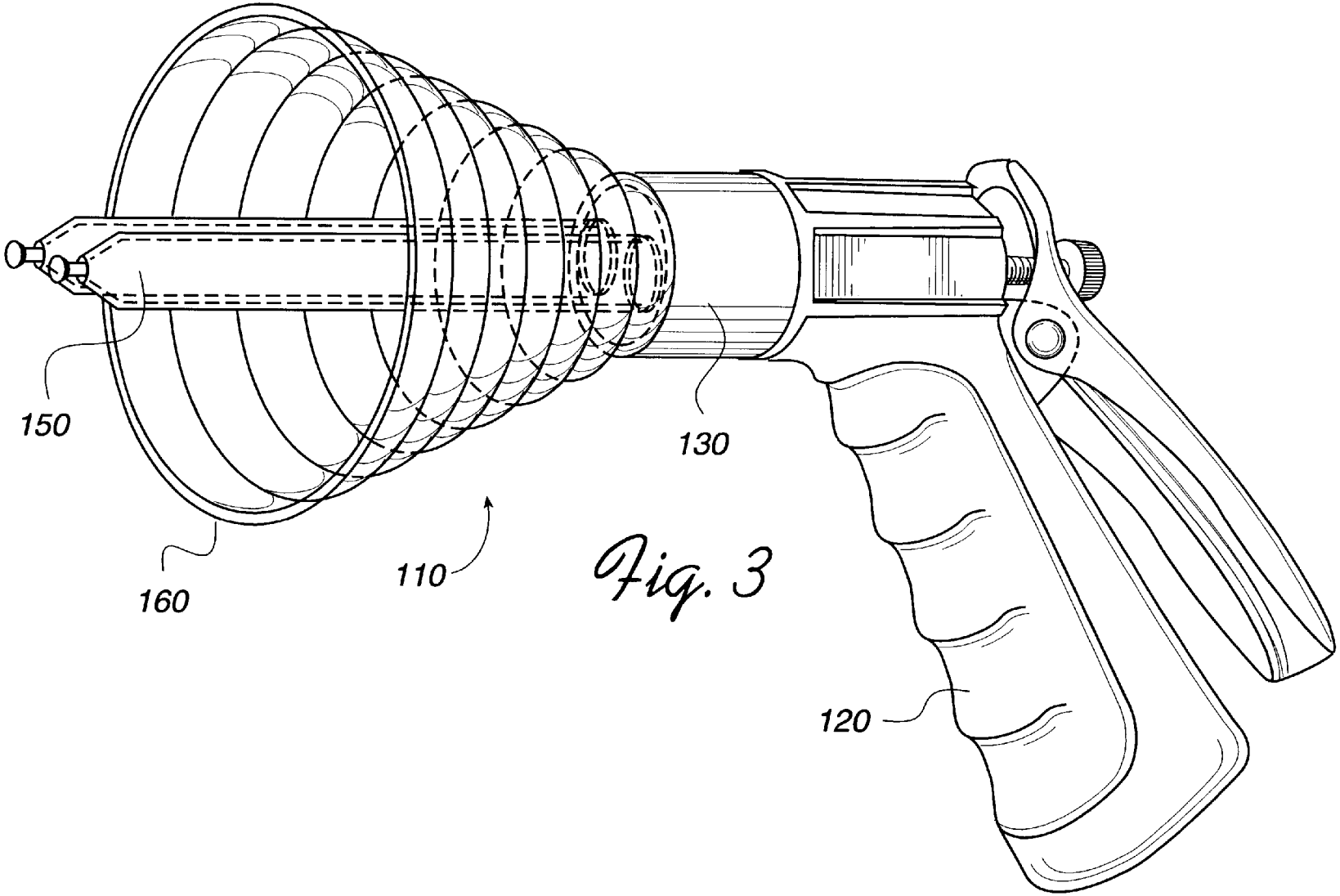
FIG. 3 illustrates a perspective view of a second embodiment of the extended fluid spray nozzle adapter.
Figure 4:
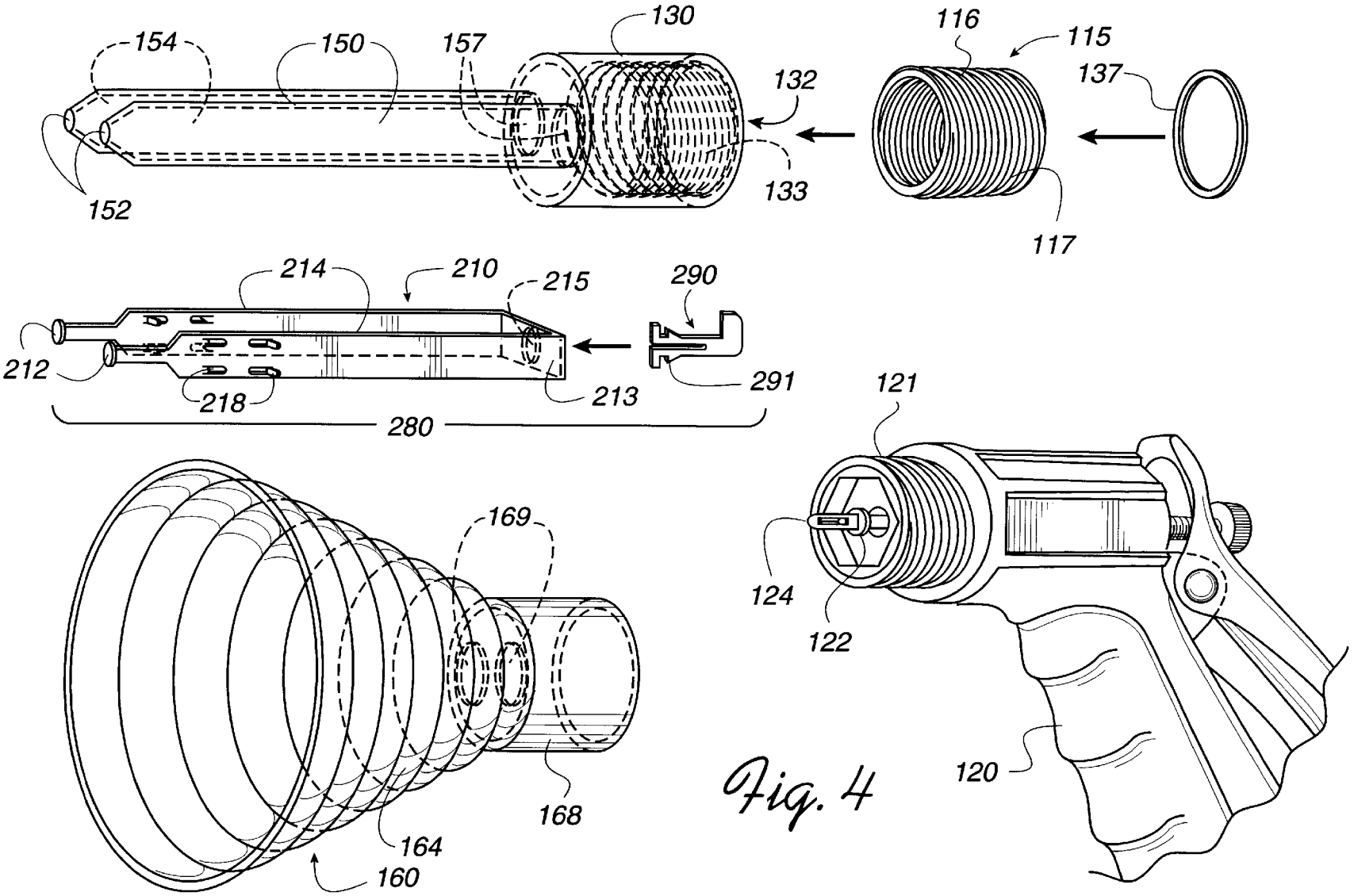
FIG. 4 illustrates an exploded view of the fluid spray nozzle adapter of FIG. 3.

FIGS. 3 and 4 illustrate a second embodiment of the present invention. The second embodiment of the spray nozzle adapter 110 shown in FIG. 3 is also suitable for use with a conventional spray nozzle 120. The spray nozzle adapter 110 has a similar construction to that of the first embodiment, except that it has a dual extended shaft 150 spatially positioned adjacent to each other for emitting two separate fluid streams. The spray nozzle adapter 110 includes an intake coupler 130 defining an intake orifice 132, two extended shafts 150 coupled to the intake, each extended shaft 150 defining an outlet orifice 152. The spray nozzle adapter 110 further includes a deflector member 160 for deflecting liquid away from the user.

FIG. 4 illustrates an exploded view which shows all of the internal components of the spray nozzle adapter 110. The intake coupler 130 has a cylindrical shape with an internal thread 133. The outer diameter of the intake coupler 130 is preferably the same as the cylindrical body of the spray nozzle 120 for matching construction and look. The intake coupler 130 forms an intake orifice 132 for receiving water from the spray nozzle 120. Securely attached to the opposite end of the intake coupler 130 are, preferably, two extended shafts 150 each having an inner cavity 154 axially extending from the intake coupler 130 and the outlet orifice 152. The intake orifice 132, inner cavity 154 and the outlet orifice 152 are all in fluid communication with each other.

On the inner surface of the intake coupler 130, there is provided an inner thread 133 formed between the beginning of the intake orifice 132 and the substantially middle portion of the intake coupler 130 for receiving a cylindrical adapter 115 having a matching outer thread 116. The cylindrical adapter 115 has an inner thread 117 which mates with a thread 121 of the spray nozzle 120.

There is also provided a washer 137, in a shape of a ring, configured to be fitted inside the cylindrical adapter 115 to form a watertight seal between the spray nozzle 120 and the intake coupler 30. The washer 37 is made of any suitable fluid sealing material, such as rubber, plastic, metal, etc.

Provided in the inner cavities 154 of the extended shafts 150 is a valve assembly 280. The valve assembly 280 includes a substantially U-shaped valve 210 and a hook 290. The valve 210 is preferably made of any suitable rigid material, such as steel or plastic. The valve 210 has a base 213 and two prongs 214. Each prong 214 is configured to fit inside each inner cavity 154 of the shaft 150 through a cavity opening 157. The width of the prong 214 is slightly smaller than the inner width of the inner cavity 154 to allow axial movement of the valve 210. The valve 210 also has two plugs 212, each plug 212 being disposed at the tip of each prong 214. The plugs 212 are used for stopping the flow of water from the outlet orifice 152. The diameter of each plug 212 is slightly larger than the diameter of the outlet orifice 152 to completely block the flow of water.

In order to place the plugs 212 centrally with regard to the outlet orifices 152, there provide are a plurality of support legs 218 protruding from the prongs 214. Each support leg 218 may be formed by bending a portion of prong 214 outward thus allowing each leg 218 to make contact with the inner walls of the shaft 150. Alternatively, the legs 218 may be formed as protrusions when the valve 210 is molded. Preferably, there are four legs 218 formed on each prong 214, two legs 218 extending outward with the other two legs 218 extending inward.

The hook 290 couples the valve 210 of the spray nozzle adapter 210 to the nozzle plug 122 of the spray nozzle 120. Preferably, the nozzle plug 122 has an extension 124 with a hole for engaging the hook 290. The hook 290 is coupled to the base 213 of the valve 210 through an aperture 215. The hook 290 has a neck portion 291 which couples to the aperture 215. Alternatively, the hook 290 and the valve 210 may be made of a single integral piece material. Furthermore, in lieu of using the hook 290 and the extension 124, the second embodiment of the present invention may utilize an alternative way to engage the nozzle plug 122 of the spray nozzle 120 with the valve 210 so that the movement of the nozzle plug 122 is relayed to the valve 210. For instance, the base portion 213 of the valve 210 may have an extension having a lever 90 with parallel notches 92, such as one shown in FIG. 2, to engage the nozzle plug 122.

The deflector member 160 is shown in both FIGS. 3 and 4. Similar to that of the first embodiment, the deflector member 160 of the second embodiment has an accordion-type shell which allows it to be retracted when the lower member is depressed against a firm surface, such as the ground. In particular, the deflector member 160 has a plurality of rigid rings 164 with flexible membranes (not shown but similar to 62 in FIG. 1) interposed between the rigid rings 164. The base portion 168 of the deflector member 160 has a cylindrical shape and is made of an elastic material to enable the base portion 168 to cover the intake coupler 130. In other words, the shaft 150 and the intake coupler 130 assembly is inserted into the deflector's base portion 168 through two openings 169. When fully inserted, the two shafts 150 protrude out of the base member 168, while the base member 168 covers the intake coupler 130, as shown in FIG. 3.

The assembling of the spray nozzle adapter 210 is as follows. First, the hook 290 is inserted into the aperture 215 of the valve 210. The entire valve assembly 280 is inserted in the inner cavity 154 of the extended shaft 150. The other end of the hook 290 is inserted into a hole of the extension 124 formed on the nozzle plug 122.

The cylindrical adapter 115 is screwed into the intake coupler 130. Both the cylindrical adapter 115 and the intake coupler 130 are screwed onto the spray nozzle 20. When the intake coupler 130 is completely mounted to the spray nozzle 120, the plugs 212 of the valve 210 completely block the outlet orifices 152.

The deflector member 160 is disposed on the intake coupler 130 and is securely mounted by the elastic type material of the base portion 168 which covers the intake coupler 130. The intake coupler 130 and the extended shaft 150 of the second embodiment may be made of any suitable metal or rigid plastic material, such as steel, stainless steel, copper, etc.

The operation of the spray nozzle adapter 110 according to the second embodiment is discussed below. After a desired ground spot is located, two extended shafts 150 are inserted into the ground. Due to the sharp and narrow construction of the extended shafts 50, penetration into the ground can be easily accomplished without much force. When the extended shafts 150 are inserted, the deflector member 160 fully covers the outer parameter to prevent any splashing of fluid and dirt. When the trigger is depressed in the spray nozzle 120, the nozzle plug 122 is pulled back which in turn retracts the valve 210. As a result, pressurized water is emitted from the outlet orifices 152, loosening the dirt and surrounding regions. The softening of dirt allows for easy retraction of weeds or unwanted plants from the ground.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A spray nozzle adapter for use with a spray nozzle having a nozzle plug to regulate the flow of fluid in response to a control lever, the spray nozzle adapter comprising:

an intake coupler having an axially extending cylindrical wall defining an intake orifice constructed to couple to the spray nozzle;

a shaft coupled to the intake coupler, the shaft having a substantially elongated inner wall defining a fluid passage and an outlet orifice; and a valve assembly coupled to the nozzle plug and disposed in the fluid passage of the shaft for controlling the flow of fluid from the spray nozzle in response to movement of the control lever of the spray nozzle, wherein the valve assembly includes a valve and a lever coupled to the valve, the valve having a plug for controlling the flow of fluid out of the outlet orifice, and the lever securely coupled to the nozzle plug of the spray nozzle to relay movement of the nozzle plug to the valve.

2. A spray nozzle adapter of claim 1, wherein the lever has parallel notches formed on one end for engaging the nozzle plug.

3. A spray nozzle adapter of claim 1, wherein the shaft is approximately 2½ inches long.

4. A spray nozzle adapter of claim 1, further including a deflector coupled to the intake coupler and substantially surrounding the shaft.

5. A spray nozzle adapter of claim 4, wherein the deflector includes a plurality of rings axially interleaved and connected with an elastic material to allow the plurality of rings to retract to expose the shaft.

6. A spray nozzle adapter of claim 4, wherein the deflector is substantially cone-shaped.

7. A spray nozzle adapter for use with a spray nozzle having a nozzle plug to regulate the flow of fluid in response to a control lever, the spray nozzle adapter comprising:

an intake coupler having an axially extending cylindrical wall defining an intake orifice constructed to couple to the spray nozzle;

a first shaft coupled to the intake coupler, the first shaft having a substantially elongated inner wall defining a first fluid passage and a first outlet orifice;

a second shaft coupled to the intake coupler and disposed spatially adjacent to the first shaft, the second shaft having a substantially elongated inner wall defining a second fluid passage and a second outlet orifice; and a valve assembly coupled to the nozzle plug and disposed in both fluid passages of the first and second shafts for controlling the flow of fluid from the spray nozzle in response to movement of the control lever of the spray nozzle.

8. A spray nozzle system comprising:

a spray nozzle having a nozzle plug to regulate flow of fluid in response to a control lever;

an intake coupler having an axially extending cylindrical wall defining an intake orifice constructed to couple to the spray nozzle;

at least one shaft coupled to the intake coupler, the shaft having a substantially elongated inner wall defining a fluid passage and an outlet orifice; and a valve assembly coupled to the nozzle plug and disposed in the fluid passage of the shaft for controlling the flow of fluid from the spray nozzle in response to the movement of the control lever of the spray nozzle, wherein the valve assembly includes a valve and a lever coupled to the valve, the valve having a plug for controlling the flow of fluid from the outlet orifice, and the lever securely coupled to the nozzle plug of the spray nozzle to relay movement of the nozzle plug to the valve.

9. A spray nozzle system of claim 8, wherein the lever has parallel notches formed on one end for engaging the nozzle plug.

10. A spray nozzle system of claim 8, further including a deflector coupled to the intake coupler and substantially surrounding the shaft, wherein the deflector includes a plurality of rings axially interleaved and connected with an elastic material to allow the plurality of rings to retract to expose the shaft.

11. A spray nozzle system of claim 8, further including two shafts, wherein:

a first shaft is coupled to the intake coupler, the first shaft having a substantially elongated inner wall defining a first fluid passage and a first outlet orifice;

a second shaft coupled to the intake coupler and disposed spatially adjacent to the first shaft, the second shaft having a substantially elongated inner wall defining a second fluid passage and a second outlet orifice, and wherein the valve is a U-shaped valve and the lever is a hook coupled to the valve, the valve having two prongs, each prong having a plug for controlling the flow of fluid through the respective outlet orifice, and one end of the hook secured to an aperture formed in the valve and the opposite end of the hook being coupled to the nozzle plug of the spray nozzle to relay movement of the nozzle plug to the valve.

12. A spray nozzle adapter for use with a spray nozzle having a nozzle plug to regulate the flow of fluid in response to a control lever, the spray nozzle adapter comprising:

an intake coupler having an axially extending cylindrical wall defining an intake orifice constructed to couple to the spray nozzle;

a first shaft coupled to the intake coupler, the first shaft having a substantially elongated inner wall defining a first fluid passage and a first outlet orifice;

a second shaft coupled to the intake coupler and disposed spatially adjacent to the first shaft, the second shaft having a substantially elongated inner wall defining a second fluid passage and a second outlet orifice; and a valve assembly coupled to the nozzle plug and disposed in both fluid passages of the first and second shafts for controlling the flow of fluid from the spray nozzle in response to movement of the control lever of the spray nozzle, wherein the valve assembly includes a valve and a lever coupled to the valve, the valve having a plug for controlling the flow of fluid out of the outlet orifice, and the lever securely coupled to the nozzle plug of the spray nozzle to relay movement of the nozzle plug to the valve.

13. A spray nozzle adapter of claim 12, wherein the valve assembly includes a U-shaped valve and a hook coupled to the valve, the valve having two prongs, each prong having a plug for controlling the flow of fluid through the respective outlet orifice, and one end of the hook secured to an aperture formed in the valve and the opposite end of the hook being coupled to the nozzle plug of the spray nozzle to relay movement of the nozzle plug to the valve.

14. A spray nozzle adapter of claim 13, wherein each prong of the valve has a plurality of legs protruding from the prong to substantially maintain the position of the nozzle of the valve in the middle of the respective outlet orifice.

15. A spray nozzle adapter of claim 12, wherein each one of the shafts is approximately 2½ inches.

16. A spray nozzle adapter of claim 12, further including a deflector coupled to the intake coupler and substantially surrounding the first and second shafts.

17. A spray nozzle adapter of claim 16, wherein the deflector includes a plurality of rings axially interleaved and connected with an elastic material to allow the plurality of rings to retract to expose the shaft.

18. A spray nozzle adapter of claim 16, wherein the deflector includes a base portion having a cylindrical shape and being made of an elastic material to be placed in surrounding relation to the intake coupler.

19. A spray nozzle adapter of claim 12, wherein the deflector is substantially cone-shaped.

* * * * *